US005096259A

United States Patent [19]

Stanfield

[11] Patent Number: 5,096,259

[45] Date of Patent: Mar. 17, 1992

[54] STACKABLE FOLDING CHAIR AND RETROFIT APPARATUS

[76] Inventor: John Stanfield, 425 Riverhill Dr., Atlanta, Ga. 30328

[21] Appl. No.: 763,968

[22] Filed: Sep. 23, 1991

[51] Int. Cl.[5] ..... A47C 3/04; A47C 4/10

[52] U.S. Cl. ..... 297/239; 297/58

[58] Field of Search ..... 297/239, 58, 16; 108/53.1, 91; 248/501; 211/194

[56] References Cited

U.S. PATENT DOCUMENTS

| | | | |
|---|---|---|---|
| 1,355,486 | 10/1920 | Longenechen | 108/91 X |
| 3,021,175 | 2/1962 | Norquist | 297/239 X |
| 3,087,755 | 4/1963 | Boman | 297/239 |
| 3,157,423 | 11/1964 | Brie, Sr. | 294/67 |
| 3,314,718 | 4/1967 | Crandall | 297/239 |
| 3,316,016 | 4/1967 | Peterson | 297/239 |
| 3,319,999 | 5/1967 | Lieberman et al. | 297/457 |
| 3,451,718 | 6/1969 | Kaufman | 297/239 |
| 3,671,074 | 6/1972 | Bergstrom | 297/239 |
| 4,010,978 | 3/1977 | Rosen | 297/239 |
| 4,350,099 | 9/1982 | Persson | 108/56.1 |
| 4,648,653 | 3/1987 | Rowland | 297/239 |
| 4,978,168 | 12/1990 | Piretti | 297/246 |

FOREIGN PATENT DOCUMENTS

| | | | |
|---|---|---|---|
| 1909558 | 9/1970 | Fed. Rep. of Germany | 297/239 |
| 633255 | 2/1962 | Italy | 108/91 |

*Primary Examiner*—Peter R. Brown
*Attorney, Agent, or Firm*—Kennedy & Kennedy

[57] ABSTRACT

Folding chairs have interlocking braces 27 and 28 that prevent relative movement between chairs in a stack. The braces have offset rear stops 30 and forward lugs 31. The braces are mounted to the sides of the legs such that they prevent sideways sliding movement of another chair stacked thereon and prevent lengthwise movement of chairs of like construction stacked thereon by the brace lugs of one chair striking the brace stops of the other.

5 Claims, 3 Drawing Sheets

STACKABLE FOLDING CHAIR AND RETROFIT APPARATUS

TECHNICAL FIELD

This invention relates to chairs, and particularly to folding chairs that may be stacked one upon another.

BACKGROUND OF THE INVENTION

Hotels and caterers use folding chairs for special events since they can be folded into generally flat configurations so that they may be compactly transported and stored in stacks for space economy and moving efficiency. The stacks of chairs may be oriented vertically or horizontally and moved about upon hand tracks or carts.

Where a large number of chairs are stacked horizontally the size of the stack is limited by the size of the transport cart support on which the chairs are placed, thus limiting the number of chairs which may be moved as a stack. Another problem associated with horizontal stacking is that once the chairs are collapsed and stacked they stand on only two legs, thus making them unstable and prone to tipping. Also, because the chairs in horizontal stacks are unstable, they often move against each other causing them to be marred. Similarly, where a number of chairs are stacked vertically they also tend to slide on each other, again causing the stack to be unstable and prone to tipping that can cause them to be scratched and marred.

It thus is seen that a need remains for a folding chair of the type which may be stacked securely into stable stacks and to apparatus that may be attached to existing folding chairs to retrofit and convert them to this type. Accordingly, it is to the provision of such that the present invention is primarily directed.

SUMMARY OF THE INVENTION

In a preferred form of the invention a stackable, folding chair of the type having a pair of front legs, a pair of back legs, a seat and a back adapted to be folded into a generally flat configuration is provided with interlock means for preventing another chair of like construction stacked thereon or thereunder from sliding thereon or thereunder. The interlock means comprises at least two braces each having a lug on one side and a stop on an opposite side offset from the lug. The two braces are mounted to the chair legs such that lengthwise sliding movement of a chair upon or under another chair of like construction is limited by engagement of the lugs with the brace stops of the other chair and sideways movement limited by the legs of the other chair engaging the brace stops.

In another preferred form of the invention, a brace for use or retrofit use on a stackable, folding chair in interlocking the chair with another chair of like construction to prevent one from sliding upon the other in a stack. The brace has a lug on one side thereof and a stop on an opposite side thereof offset from the lug, and mounting means for mounting the brace aside a chair leg with the stop projecting beyond the leg. With the brace mounted to the chair the brace stop may engage the lug of a brace of another chair stacked thereon or thereunder so as to limit lengthwise sliding movement of one chair on the other and engage the leg of the other chair in limiting sideways movement of it.

DETAILED DESCRIPTION

Figure 1:
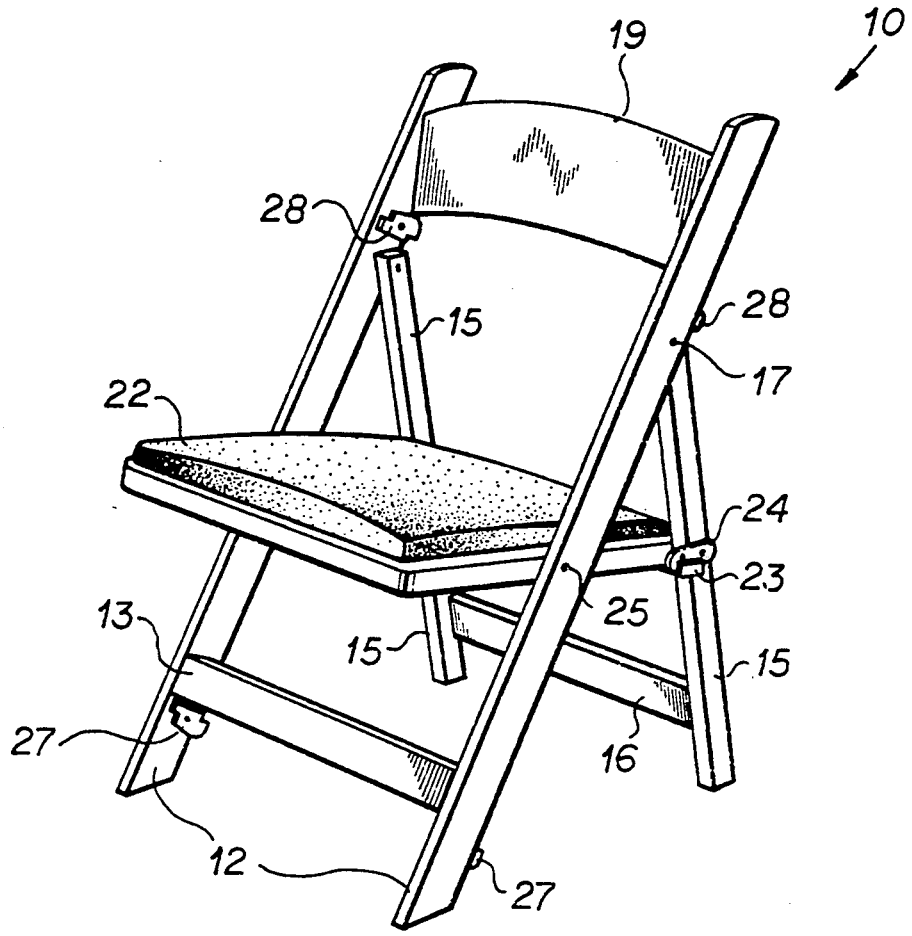
FIG. 1 is a perspective view of a folding chair having legs with flat sides shown in an unfolded, erected configuration that embodies principles of the present invention.

With reference next to the drawing, there is shown in FIG. 1 a stackable folding chair 10 having a pair of front legs 12 spanned by a support strut 13, and a pair of back legs 15 spanned by another support strut 16, the back legs being pivotably mounted to the front legs by two pivots 17. A back support 19 is mounted to the upper ends of the front legs 12.

A seat 22 is pivotably mounted to the front legs by pivots 25 and to the back legs by hinges 24. U-shaped brackets 23 are mounted to the bottom of the seat to extend out from its sides. Engagement of the brackets against the hinges 24 serve to lock the seat 22 in an erected configuration while yet allowing the seat to be folded.

Figure 3:
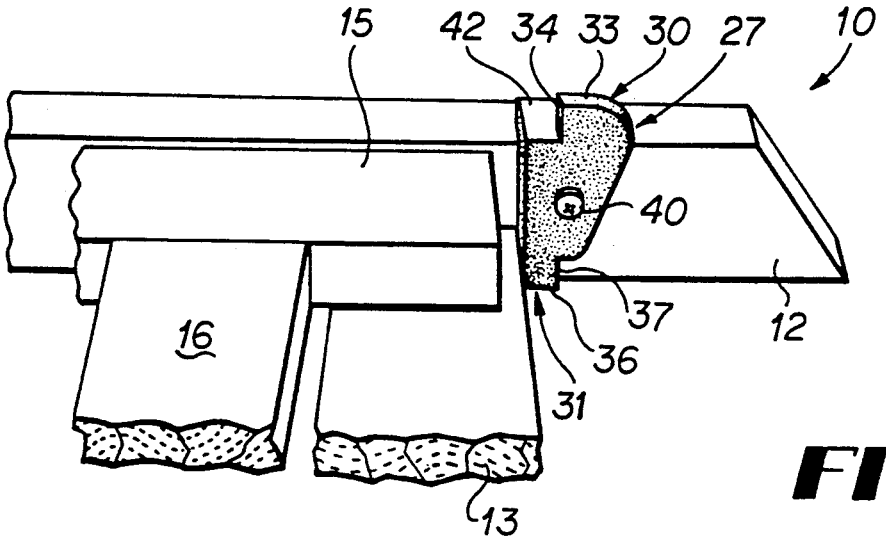
FIG. 3 is a perspective view of a portion of the chair shown in FIG. 1 showing one of its four braces in greater detail.
Figure 4:
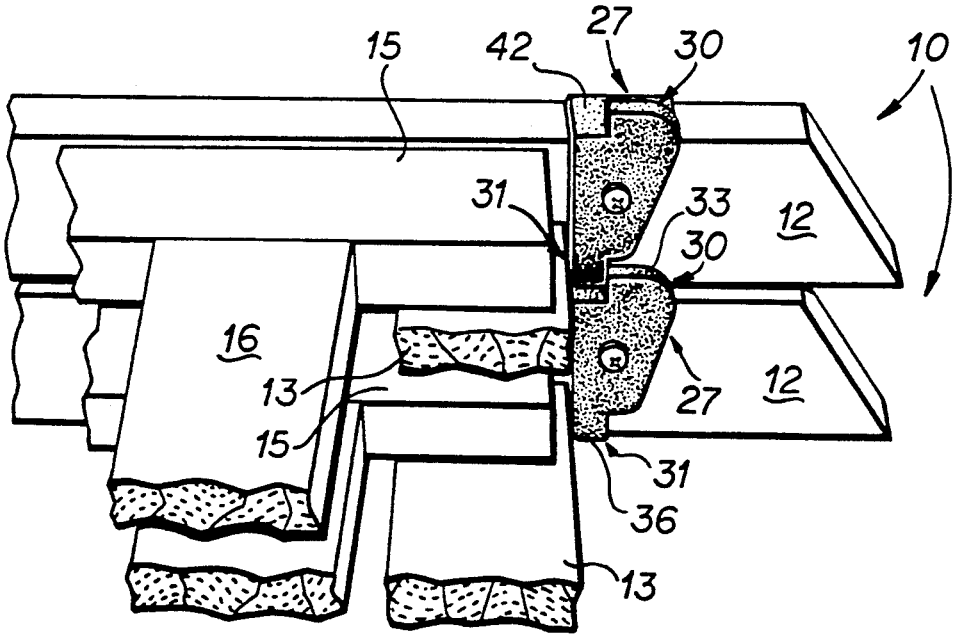
FIG. 4 is a perspective view of portions of the two stacked chairs of FIG. 2 showing a brace of each chair interlocked.

A pair of plastic braces 27 is mounted to the insides of the front legs 12 beneath support strut 13 and another pair of plastic braces 28 of similar construction is mounted to the insides of the front legs beneath the back support 19. Alternatively, they could be mounted to the outside of the legs, but that is not preferred. As best shown in FIGS. 3 and 4, each brace has a rear stop 30 extending beyond the rear edge of the chair leg and a forward lug 31 positioned flushly alongside the chair leg and offset from the rear stop 30. Each rear stop 30 has a rounded rear bearing surface 33, and a flat lug limiting or stop surface 34 oriented normally to the leg rear. Each forward lug 31 has a flat, forward bearing surface 36 and a flat contact surface 37 oriented normally to the surface 36. Each brace further has a flat, flanged seat 42 that overlays the rear edge of the chair leg with a small portion extending to the front of the stop. Each brace also has a mounting hole through which a mounting screw 40 passes in mounting the brace to the inside of a leg 12.

Figure 2:
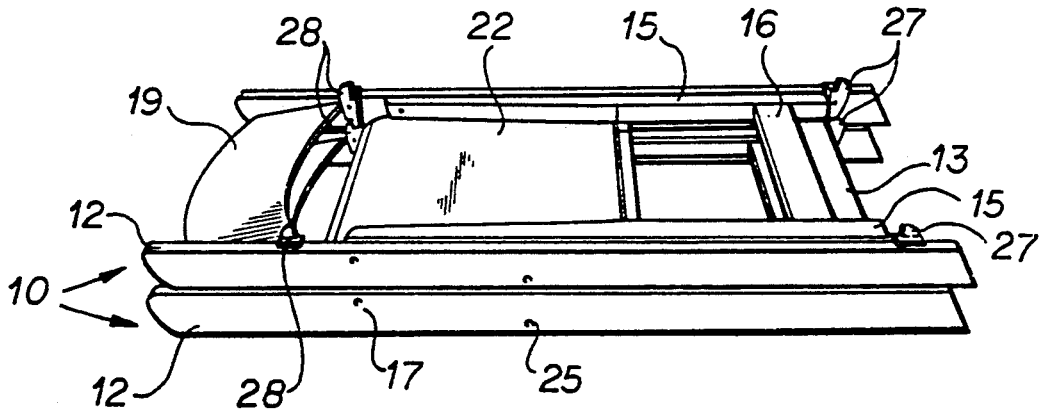
FIG. 2 is a perspective view of two of the folding chairs of FIG. 1 shown in a folded configuration stacked vertically one upon the other.

In use, several chairs 10 may be folded into a flat configuration and stacked one atop another to form a vertical stack of chairs, as shown in FIG. 2. Though only two chairs are shown here for clarity, the stack may be much larger. The chairs are stacked by positioning one chair in alignment with and above another and lowering the upper chair until it comes to rest upon the lower chair with the lugs 36 of the braces of the upper chair positioned above the seat 42 of the braces of the lower chair, as shown in FIGS. 2 and 4. In this position the sides of the legs 12 of the upper chair are located beside the brace stops 30 of the lower chairs upon the brace flanged seats 42. Thus, the two legs 12 of the upper chair straddle the stops of the braces 27 and 28 of the lower chair which serves to prevent any side to side movement of one chair relative to the other. Since any movement of the upper chair to the right, as viewed in FIG. 4, is prevented by the lugs of the braces 27 of the upper chair contacting the stops 30 of the braces 27 of the lower chair, and any opposite movement is prevented by contact of the lugs of the braces 28 of the upper chair contacting the stops 30 of the braces 28 of the lower chair, the two chairs are now interlocked. Thus, the four braces now serve to prevent any significant sliding movement of one chair upon the other. Relative movement can now only be imparted by lifting the upper chair off the lower chair.

The braces also aid in aligning the upper chair into its interlocked position upon the lower chair without marring the surface finish of either chair. A slight misalignment of the upper chair in the lengthwise direction will cause the forward bearing surface 36 of one pair of braces to contact and rest upon the bearing surface 33 of the similarly located pair of lower chair braces. Thus, only the contacting braces and a small portion of the chair on the opposite end of the chair from the contacting braces are in contact. To correct the alignment the upper chair is simply slid lengthwise until its forward lugs 31 fall off the bearing surface 33 of the underlying braces into their correct, interlocked position. As the chair legs are supported on the plastic braces themselves, and interlocked, their surfaces are unlikely to become scratched or marred.

Figure 5:
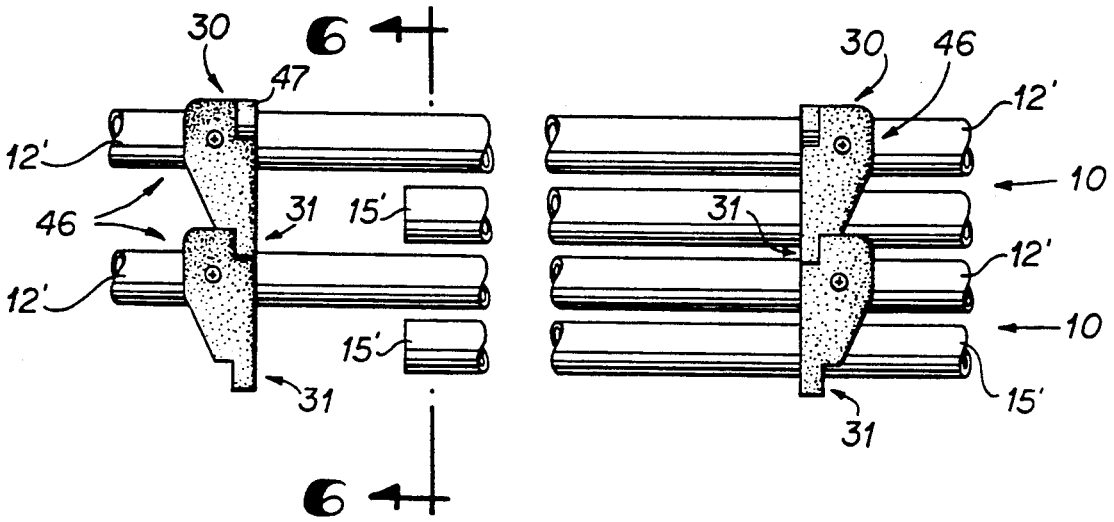
FIG. 5 is a side elevational view of braces embodying principles of the invention in another preferred form shown mounted on round chair legs.
Figure 6:
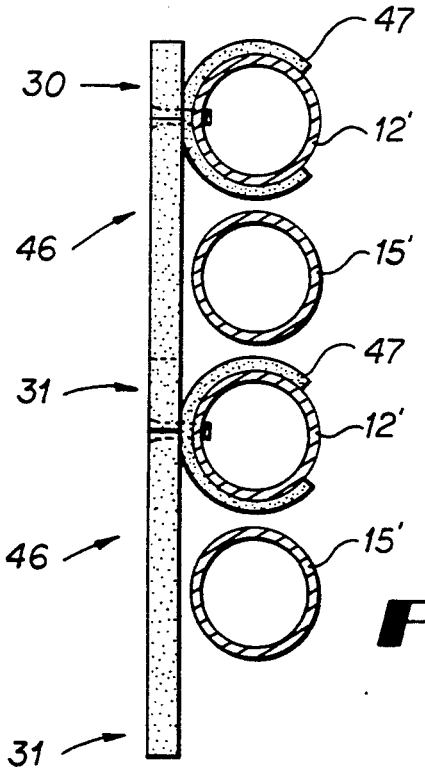
FIG. 6 is a sectional view of the apparatus shown in FIG. 5 taken along plane 6—6.

In FIGS. 5 and 6 braces 46 in an alternative form are shown on chairs having round legs instead of flat legs. These are essentially the same as the previously described braces of FIGS. 1–4 except that here they include thin, resilient clamps 47 that are snapped onto the round chair legs 12 and 15. Interlock is accomplished in essentially the same manner as previously described.

From the foregoing, it is seen that a stackable folding chair is now provided which overcomes problems long associated with those of the prior art. Moreover, pre-existing chairs may be readily modified by simply retrofitting them with the braces. However it should be understood that the just described embodiments merely illustrate principles of the invention in preferred form. Many modifications, additions and deletions may, in addition to those expressly recited, be made thereto without departure from the spirit and scope of the invention as set forth in the following claims.

I claim:

1. In a stackable, folding chair of the type having a pair of front legs, a pair of back legs, a seat and a back adapted to be folded into a generally flat configuration, the improvement comprising interlock means for preventing another chair of like construction stacked thereon or thereunder from sliding thereon or thereunder, and with said interlock means comprising at least two braces each having a lug on one side and a stop on an opposite side offset from said lug, and with said two braces being mounted to said legs such that lengthwise sliding movement of said chair upon or under another chair of like construction is limited by engagement of said lugs with the brace stops of the other chair.

2. The improvement of claim 1 wherein said two braces are mounted to said front legs.

3. The improvement of claim 1 wherein said two braces are mounted to a common one of said legs.

4. The improvement of claim 1 wherein said interlock means comprises two pairs of said braces with one of said pairs of braces being mounted to one of said chair legs and another of said pairs of braces being mounted to another of said chair legs.

5. The improvement of claim 4 wherein said one pair is mounted to an inside of one of said chair legs with said brace stops projecting therebeyond and the other of said pair is mounted to the inside of the other of said legs with said brace stops projecting therebeyond, whereby sideways relative movement of one chair upon the other is limited bidirectionally by engagement of the chair legs with the stops of the braces of the other chair.

* * * * *